United States Patent [19]

Hopf et al.

[11] 4,057,239

[45] Nov. 8, 1977

[54] VISE

[75] Inventors: Heribert Hopf; Siegfried Schramm, both of Schwabisch Hall, Germany

[73] Assignee: Keiper GmbH, Schwabisch Hall, Germany

[21] Appl. No.: 676,915

[22] Filed: Apr. 14, 1976

[30] Foreign Application Priority Data

Apr. 26, 1975 Germany ..... 7513517[U]

[51] Int. Cl.[2] ..... B25B 5/02

[52] U.S. Cl. ..... 269/170

[58] Field of Search ..... 269/166–170

[56] References Cited

U.S. PATENT DOCUMENTS

| | | | |
|---|---|---|---|
| 2,262,196 | 11/1941 | Olsen | 269/167 |
| 2,735,323 | 2/1956 | Phillips | 269/167 |
| 2,846,907 | 8/1958 | Sprink | 269/167 |

*Primary Examiner*—Robert C. Watson
*Attorney, Agent, or Firm*—Michael J. Striker

[57] ABSTRACT

A clamp usable as a vise has a fixed clamping member and a movable clamping member movable toward and away from the fixed clamping member along a guide. A tippable locking element has a hole through which passes an elongated locking element that extends in the direction of displacement of the clamping member. The tippable element can be displaced between a slide position wherein the hole loosely surrounds the elongated element and allows it to move relative to the tippable element and a locked position with the tippable element canted and the elongated element wedged in the hole. Furthermore once the tippable element is in the canted position it can further be displaced so as to bring extra clamping force to bear on a workpiece between the two clamping members.

23 Claims, 17 Drawing Figures

VISE

BACKGROUND OF THE INVENTION

The present invention relates to a clamp. More particularly this invention concerns a clamp usable as a vise for holding a workpiece.

A clamp is known having a fixed member or jaw relative to which a movable member or jaw is displaceable. A threaded spindle is typically provided for displacing this movable member along a guide relative to the fixed member to clamp a workpiece between these members. Such a system allows a relatively great clamping force to be made effective on the workpiece. This clamping force is applied at a mechanical advantage which is inversely proportional to the pitch of the screw thread. Thus when a screw thread of very flat pitch is used a relatively great mechanical advantage can be gained. On the other hand, however, the speed with which the two elements can be moved together is directly proportional to the steepness of the pitch so that with a relatively steeper pitch the two elements can be moved together and apart very rapidly. Thus it is necessary to trade off the desirability of a good mechanical advantage against the similarly desirable feature of quick opening and closing.

It has been suggested to provide a half nut on the movable member engageable with the spindle. Thus the half nut can be lifted off the spindle to allow the movable member to slide along this spindle and is thereafter engaged over the spindle for clamping action. Such an arrangement requires two hands to operate and frequently slips apart when considerable force is applied.

SUMMARY OF THE INVENTION

It is therefore an object of the present invention to provide an improved clamp.

Another object is the provision of a workpiece-holding vise which overcomes the above-given disadvantages.

Yet another object is to provide such a vise which can rapidly be closed and can thereafter be used to exert considerable force on the workpiece.

Yet another object is the provision of such a clamp usable as a vise and which can be operated with one hand.

These objects are attained according to the present invention in a clamp comprising a fixed clamping member relative to which a movable clamping member is displaceable through a relatively long distance. A tippable locking element has a hole receiving an elongated locking element that extends in the closing and opening directions of displacement of the movable clamping member toward and away from the fixed clamping member. Means is provided for displacing the tippable element between a slide position in which its hole loosely surrounds the elongated element and a locked position in which the tippable element is canted and the elongated element is wedged in its hole. Means is also provided that is expansible in the opening and closing directions through a relatively short distance and which bears in one of these directions against one of the elements and in the other directions against one of the members. The other element bears in the one direction against the other member.

Thus with the system according to the present invention the workpiece is placed against the fixed clamping member and the movable clamping member is slid against the workpiece. The tippable element is then set into its locked position and the expansible means is expanded to tightly lock the workpiece between the two members.

In accordance with the present invention a guide rod is fixed in the fixed clamping member and constitutes the elongated locking element as well as a guide along which the movable clamping member may slide. Two such guide rods are provided in accordance with this invention, each with a respective tippable locking element. It is also possible to provide a guide that is independent of the locking element. In this latter case the elongated locking element is secured in an end member that is secured at one end of the guide at the other end of which is secured the fixed clamping member.

The tippable locking element may be a simple plate that is urged into the slide position by a spring. A nut carried on the tippable locking element receives a threaded end of a rod. The very end of this rod bears against the movable locking member so that when the rod is screwed into the nut it tips the locking element relative to the member and locks it on the elongated locking element. Further rotation of the threaded rod displaces the tippable locking element and the elongated locking element wedged in it relative to the movable clamping member. Thus the threaded rod and the nut constitute both the means for displacing the tippable element and the expansible means. This rod is provided with a knob so that the user need merely grasp the rod and slide the movable clamping member with it against the workpiece which is standing against the fixed member. Then the knob is rotated so as first to lock the tippable locking element on the elongated locking element and then to displace the movable member slightly relative to the tippable locking element in order to clamp the workpieces securely.

It is also possible in accordance with this invention to provide in the end member at the end of the guide opposite the fixed member the tippable locking element and the expansible means, with the elongated locking element being secured in the movable clamping member and passing through this end member. The means for tipping the tippable locking element may be a cam having a pair of portions lying in a plane non-perpendicular to the rotation axis of the cam and bearing against the locking element. Thus rotation of this locking element will tip the cam. Once again the arrangement is so set up that rotation of the cam through a predetermined angular distance tips the tippable locking element to lock it on the elongated locking element and a further rotation displaces the two locking elements relative to whichever clamping member the cam is in force-transmission engagement with.

With the system according to the present invention it is possible rapidly to clamp a workpiece using one hand. The movable member can readily be slid along the guide against the workpiece and then locked in place and tightened on the workpiece. A very simple loosening allows the movable member to be displaced rapidly away from the workpiece through a relatively large distance. The device can be operated readily with one hand and can be produced at relatively low cost. Furthermore the relatively simple construction imparts to the device a long serivce life and reliability in operation.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
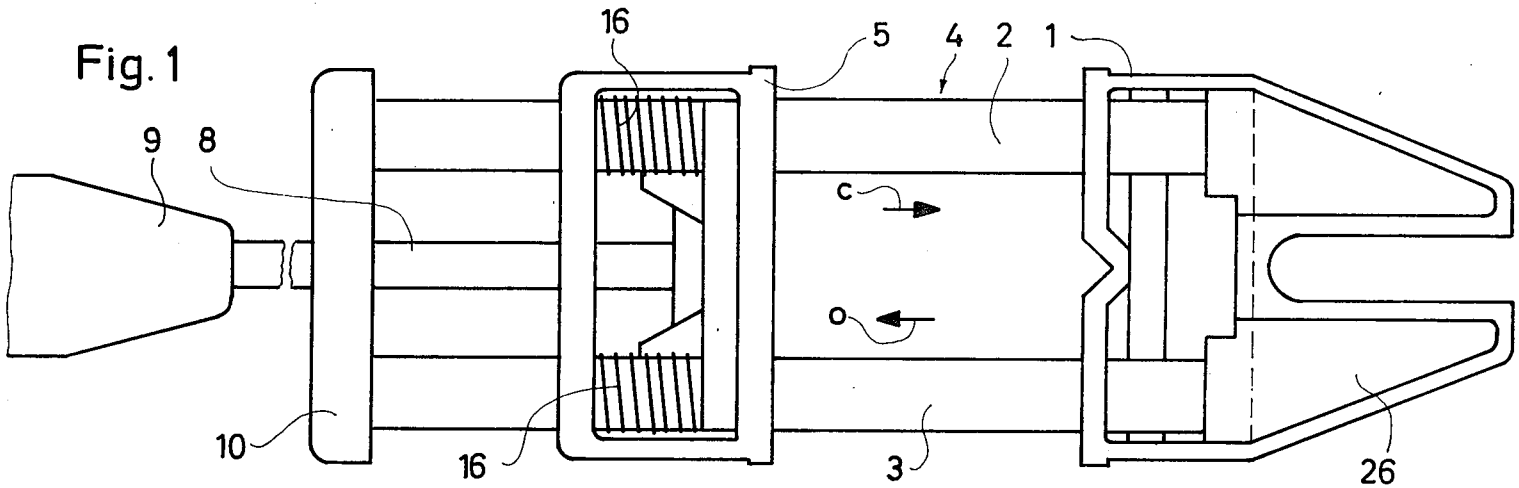
FIG. 1 is a top view of a first embodiment of a vise according to this invention.
Figure 2:
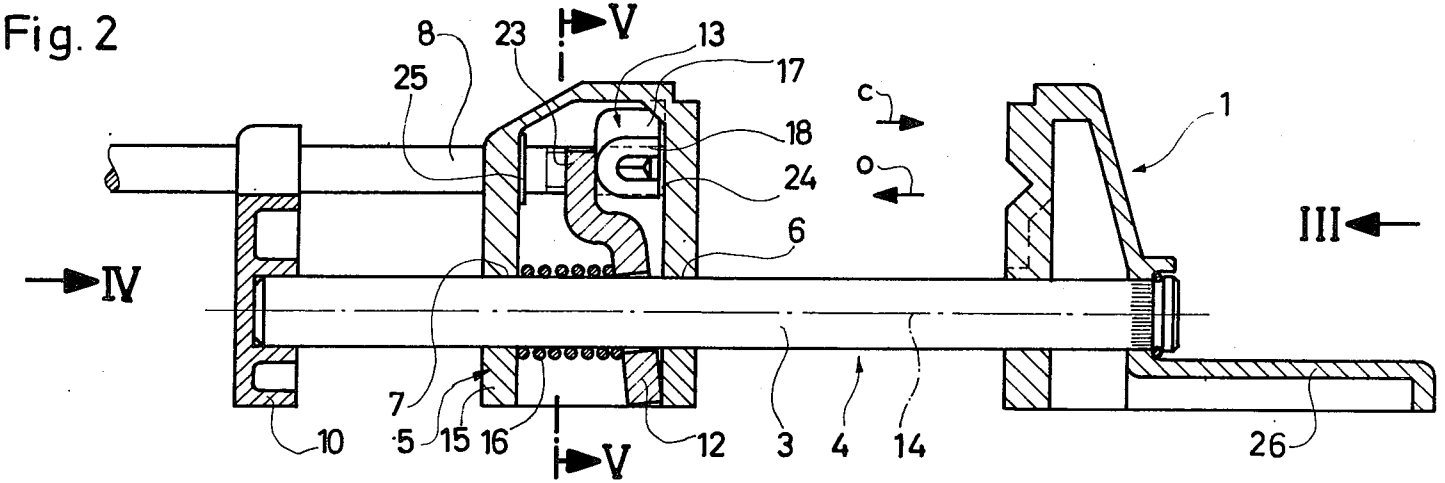
FIG. 2 is a longitudinal vertical section through the vise of FIG. 1.
Figure 3:
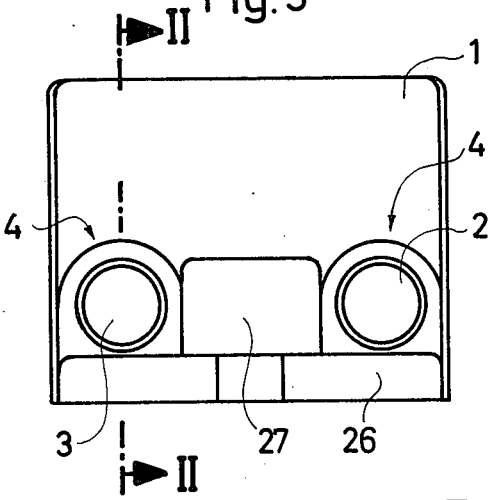
FIGS. 3 and 4 are end views taken in the direction of arrows III and IV of FIG. 2, the line II—II of FIG. 3 being a section line of FIG. 2.
Figure 4:
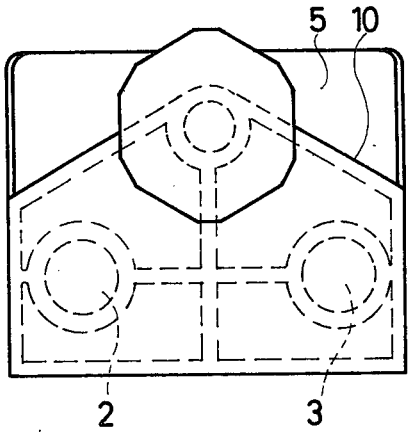

The vise of FIGS. 1–8 has a fixed clamping member 1 from which extend a pair of parallel circular-section rods 2 and 3 constituting a guide 4 for a movable clamping member or jaw slidable toward the fixed member 1 in a closing direction C and away from the fixed member 1 in an opening direction O. The movable member 5 is hollow and is formed with a pair of circular in-line holes 6 and 7 (see FIG. 2) for each of the rods 2 and 3. In addition an actuator rod 8 extending parallel to the rods 2 and 3 has at its end opposite the movable member 5 and turned away from the fixed member 1 a knob 9 and passes through an end member 10 that bridges the ends of the rods 2 and 3 turned away from the fixed member 1.

Figure 5:
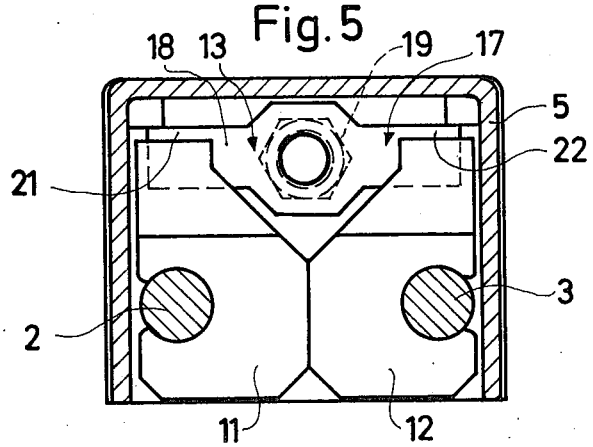
FIG. 5 is a section taken along line V—V of FIG. 2.
Figure 6:
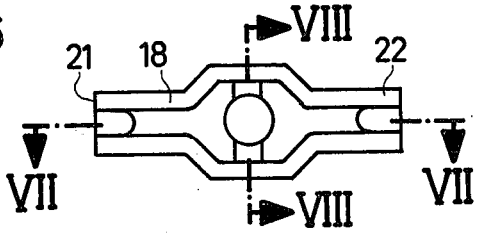
FIG. 6 is an end view of a detail of the vise of FIG. 1.
Figure 8:
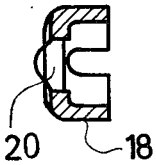
FIGS. 7 and 8 are sections taken along lines VII—VII and VIII—VIII of FIG. 6, respectively.
Figure 7:
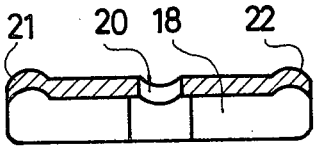

Slidable along the rods 2 and 3 are respective tippable locking elements or plates 11 and 12 having as shown in FIG. 5 holes which loosely receive the respective rods 2 and 3 when the planes of the elements 11 and 12 are perpendicular to the axes 14 of the rods 2 and 3. An adjustment element 13 is capable of tipping these plates 11 and 12 as described below. A spring 16 bears against the back side 15 of the movable element 5 and surrounds each of the rods 2 and 3 so as to urge the lower portion of the plates 11 and 12 forwardly.

The adjustment element 13 comprises a nut-holding portion formed in the middle of a body 18 that is generally channel-shaped. A nut 19 is snugly received in the portion 17 in line with a hole 20 (FIGS. 7 and 8) formed in the member 18. In addition this member has a pair of arms 21 and 22 respectively engageable with the bent-over portions 23 of the plates 11 and 12 and formed with bosses or bumps bearing against these plates 11 and 12. Thus the element 18 is extremely rigid.

A threaded end of the rod 8 is screwed into the nut 19 and is prevented from moving axially in the movable element 5 by means of a ring 25 bearing against the back plate 15. In addition the forward end of this threaded portion can bear against the front plate at 24.

The fixed member 1 is formed with a flange 26 that allows it to be bolted to a table and with a throughgoing hole 27 between the rods 2 and 3 that allows a pipe-holding block or the like to be fitted to this member 1.

The vise shown in FIGS. 1–8 functions as follows:

For use the knob 9 is rotated to unscrew the threaded rod 8 from the nut 19 until the plates 11 and 12 can assume positions perpendicular to the axes 14 of the rods 2 and 3. This allows these rods 2 and 3 to slide freely relative to the plates 11 and 12 and, therefore, allows the member 5 readily to slide along the guide 4 constituted by these rods 2 and 3. The member 5 is pulled away in the direction O for enough to receive a workpiece between the jaws constituted by the members 1 and 5 and the knob 9 is then pushed to press the workpiece between these two members 1 and 5. Rotation of the knob 9 in the opposite direction first tilts the plates 11 and 12 so as to lock them relative to the rods 2 and 3. Further rotation of this knob 9 displaces the movable member 5 in the direction C relative to the plates 11 and 12 so as to achieve a relatively high clamping force. Once whatever operation is being carried out on the workpiece has been completed the user need merely loosen the movable jaw 5 by rotating the knob 9 sufficiently to allow the plates 11 and 12 to assume their perpendicular condition. This allows the movable member 1 to be pulled completely back in the direction O and the workpiece to be removed. All of these operations can readily be carried out with one hand, the operator's other hand being usable to position the workpiece.

Figure 9:
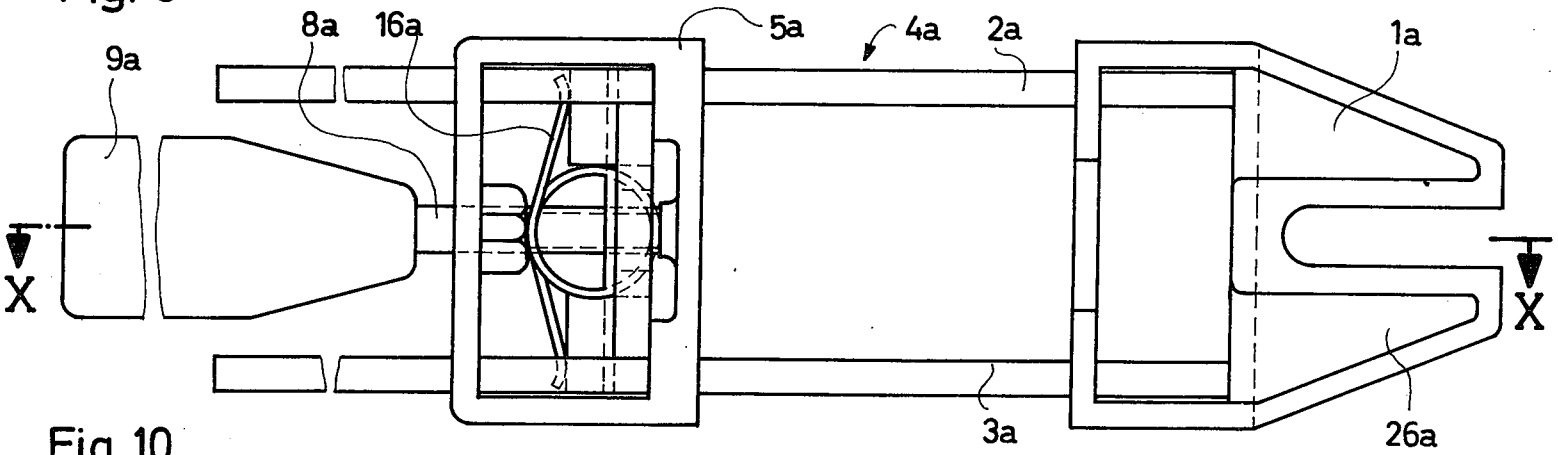
FIG. 9 is a top view of a second embodiment of a clamp usable as a vise in accordance with the present invention.
Figure 10:
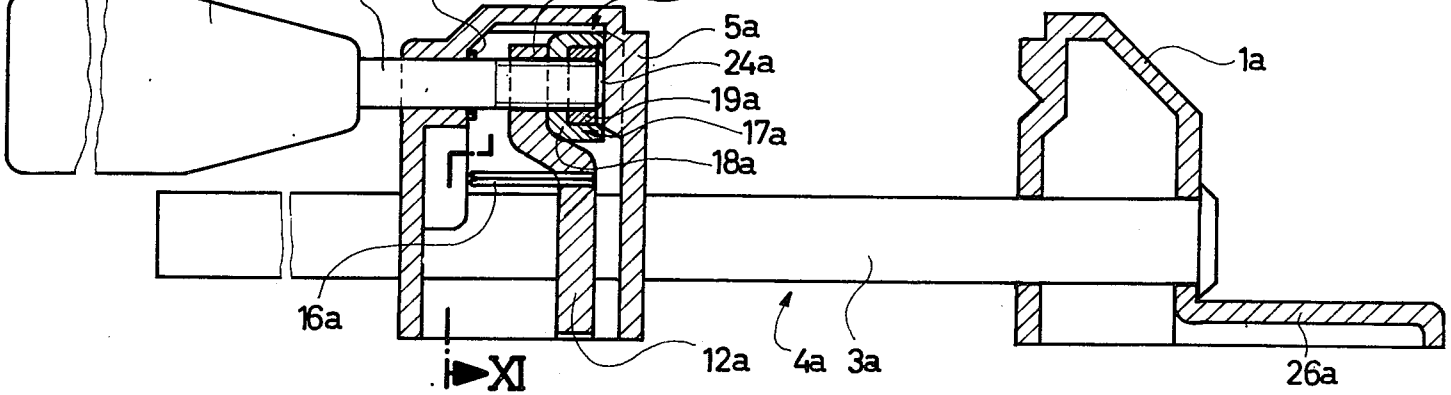
FIG. 10 is a section taken along line X—X of FIG. 9.
Figure 11:
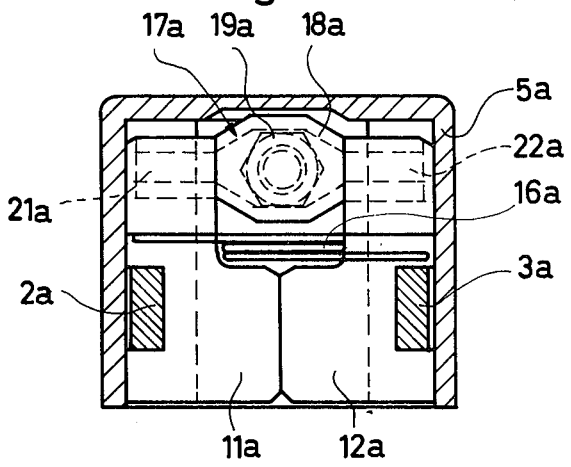
FIG. 11 is a section taken along line XI—XI of FIG. 10.

The structure of FIGS. 9–11 is functionally identical to that of FIGS. 1–8. Reference numerals for functionally identical structure carry postscripts a in FIGS. 9–11.

In this arrangement no end member 10 is provided so that the movable member 5*a* can be pulled completely off the rods 2*a* and 3*a*, which here are of rectangular section. Furthermore in this arrangement a single spring 16*a* has a pair of arms each bearing against a respective upper portion 23*a* of a respective plate 11*a* or 12*a*. Furthermore in this arrangement the handle 9*a* is relatively close to the movable member 5*a* so that the arrangement has a very wide throat, that is it can be opened to receive even relatively long or thick workpieces.

Figure 12:
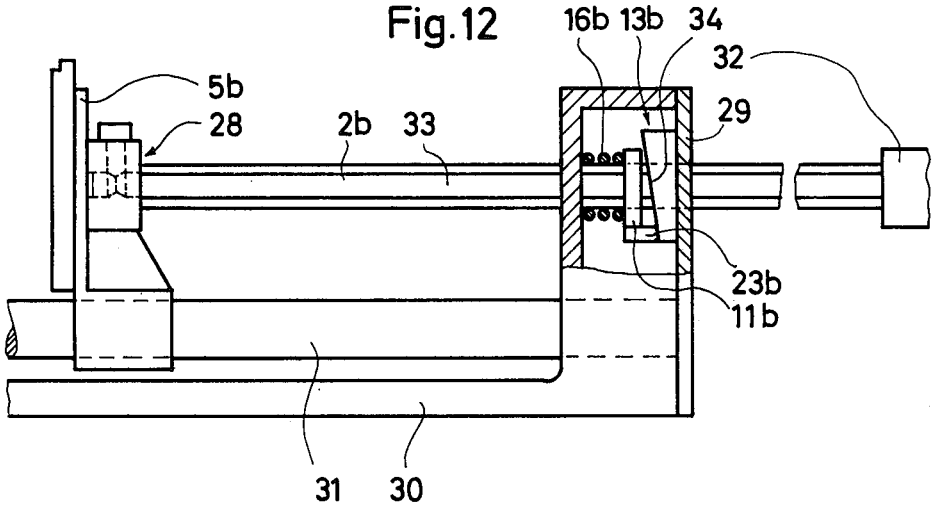
FIG. 12 is a side view partly in section of a third embodiment of the clamp in accordance with the present invention.
Figure 13:
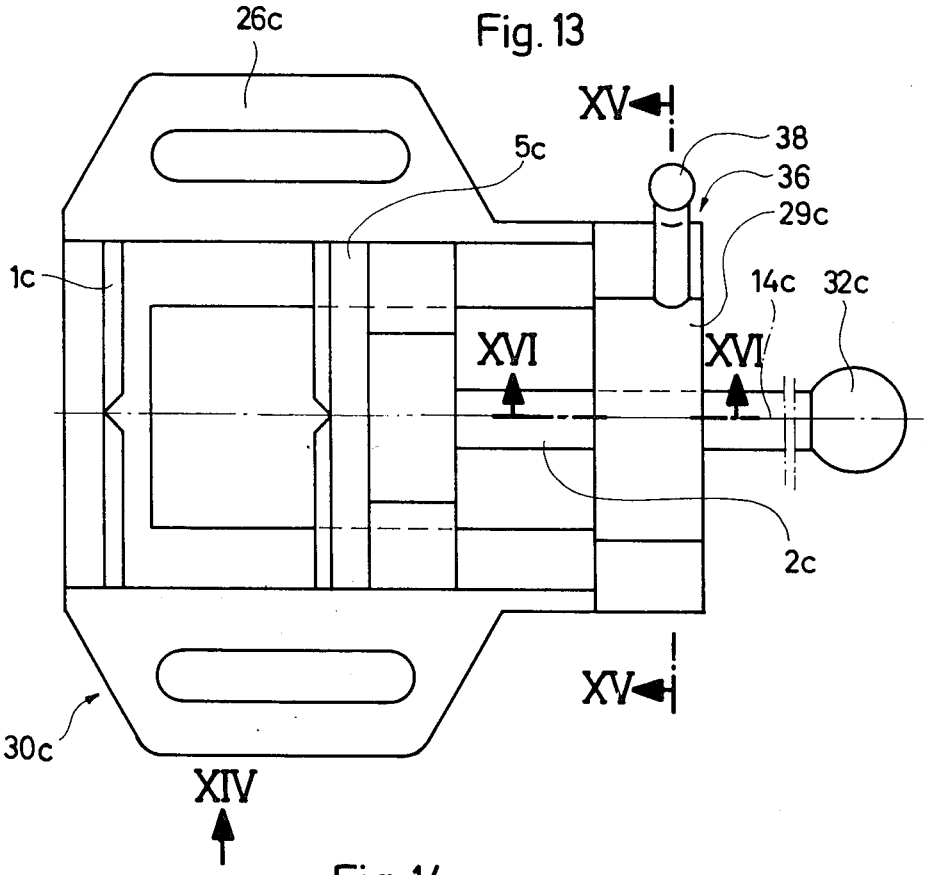
FIG. 13 is a top view of a fourth embodiment of the clamp according to this invention.
Figure 14:
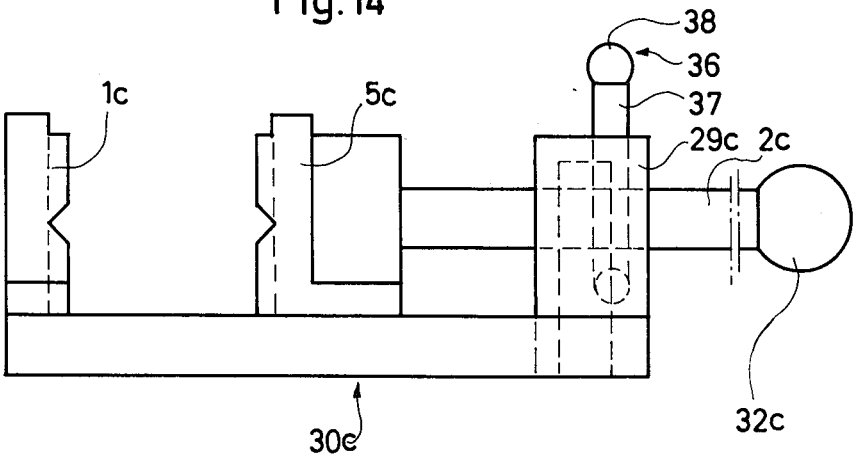
FIG. 14 is a view taken in the direction of arrow XIV of FIG. 13.
Figure 15:
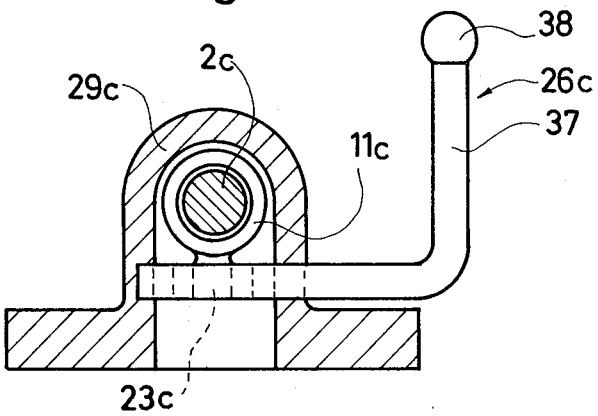
FIGS. 15 and 16 are sections taken along lines XV—XV and XVI—XVI of FIG. 13.

In the arrangement of FIG. 12 a movable member 5*b* slides along a guide 31 extending above base plate 30 that is connected at one end to the not-illustrated fixed member of the vise and at the other end to an end member 29. An elongated locking element 2*b*, here constituted as a round-section rod with a flat side 33, is axially fixed at one end 28 in the movable member 5*b* and slides axially through the end member 29. A single plate 11*b* identical to the plate 11 in function is urged by a spring 16*b* toward an adjustment element 13*b* having an inclined caming surface 34. This element 13*b* is fixed to the end member 29, but the plate 11*b*, which carries an outwardly extending arm 23*b*, is rotationally fixed to the rod 2*b* which is rotatable relative to the movable member 5b by means of a knob 32. Rotation of this rod 2b will, therefore, tip the element 11b as described above. Rotation through a predetermined angular distance will simple lock the element 11b relative to the rod 2b, and further rotation will displace the element 11b and the rod 2b relative to the end member 29 which is in force-transmission engagement with the fixed member of the vice.

The arrangement of FIGS. 13–17 has a vise with a fixed jaw or member 1c secured on a base 30c having flanges 26c securable to a bench. A movable jaw or member 5c is connected to one end of a rod 2c having an axis 14c and a knob 32c and passing through an end member 29c secured on the base 30c. A spring 16c urges a plate 11c having a hole 40 through which passes the rod 2c against a back surface 39 of the hollow interior of the end member 29c.

Figure 16:
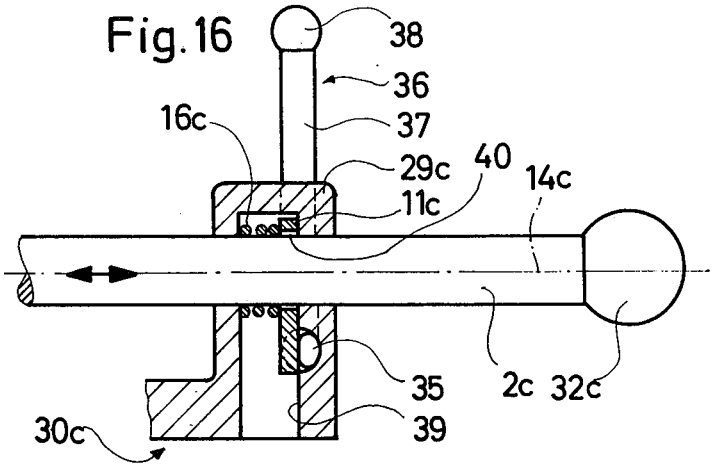
Figure 17:
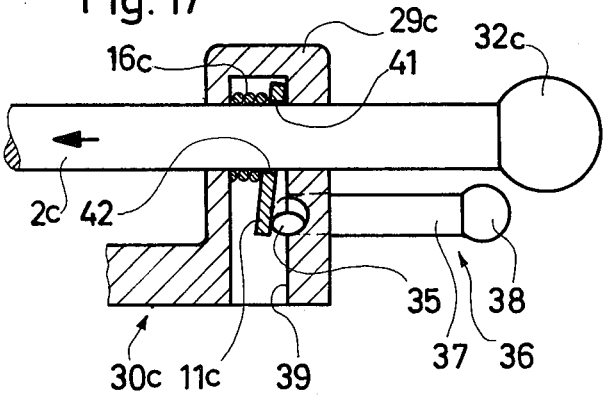
FIG. 17 is a view similar to FIG. 16 illustrating the mechanism shown in FIG. 16 in the locked rather than the slide position.

An actuator 36 comprised of a crank 37 having a knob 38 is formed at its lower end with an eccentric actuating element 35 extending in a plane perpendicular to the axis 14c. This element 35 can as shown in FIGS. 16 and 17 on tipping of the crank 37 bear against the lower portion of the plate 11c and displace it from a vertical position to a canted position. In the vertical position the rod 2c can slide relative to the plate 11c. In the canted position edges 41 and 42 of the throughgoing hole 40 wedge against the rod 2c tightly. During the first portion of the angular displacement of the crank 36 the plate 11c is locked on the rod 2c, and through the balance of its displacement through 90° the rod 2c is displaced by means of the plate 11c relative to the end member 29c which is in force-transmission with the fixed member 1c.

Such a vice is ideally usable with wood or workpieces all having substantially the same compressibility. Thus the operator need merely place the workpiece between the throat defined between the two members 1c and 5c and push the knob 32c until the workpiece is in contact with both of the jaws 1c and 5c. Then the operator need merely swing the knob 38 through 90° to tightly clamp the workpiece in place. The structure is extremely simple, with the plate 11c having a generally annular shape and formed with an outrigger or lateral extension 23c that is engaged by the eccentric actuator 35.

It will be understood that each of the elements described above, or two or more together, may also find a useful application in other types of structures differing from the types described above.

While the invention has been illustrated and described as embodied in a clamp, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A clamp comprising:

a fixed clamping member;

a movable clamping member displaceable through a relatively long distance toward said fixed member in a closing direction and away from said fixed member in an opposite opening direction;

a tippable locking element having a hole;

an elongated locking element received in said hole said extending in said direction;

means for displacing said tippable element between a slide position with said hole loosely surrounding said elongated element and a locked position with said tippable element canted and said elongated element wedged in said hole; and means expansible in said directions through a relatively short distance and including a nut bearing in one of said directions against one of said locking elements and a threaded element threaded through said nut and bearing in the other direction against one of said members, the other locking element bearing in the other direction against the other member.

2. The clamped defined in claim 1, wherein said expansible means includes an elongated rod having at one end a knob and having another end formed as said threaded element and an engagement element carrying said nut nonrotatably and bearing in said one direction on said one element.

3. The clamp defined in claim 2, wherein two such elongated elements are fixed in and extend from said fixed member through said movable member, and two such tippable elements each having one such hole receiving a respective one of said elongated elements, said rod being between said elongated elements and said engagement element bearing against both of said tippable elements.

4. The clamp defined in claim 2, wherein said rod is non-displaceable in said directions relative to said movable member.

5. The clamp defined in claim 2, further comprising an end member fixed to said elongated elements at the ends thereof opposite said fixed member, said rod passing in said directions through said one member.

6. The clamp defined in claim 2, wherein said rod is parallel to and above said elongated elements.

7. A clamp comprising:

a fixed clamping member;

a movable clamping member displaceable through a relatively long distance toward said fixed member in a closing direction and away from said fixed member in an opposite opening direction;

a tippable locking element at one of said members and having a hole;

an elongated locking element extending in said directions and nondisplaceable in said directions relative to the other of said members, said elongated locking element being received in said hole and said tippable element being displaceable between a slide position with said hole loosely surrounding said elongated element and a locked position with said tippable element canted and said elongated element wedged in said hole;

a body having a formation at said one member extending at an inclination to said directions and nondisplaceable in said directions relative to said one member;

a body bearing in one of said directions on said formation and in the other of said directions on said tippable element; and means for rotating one of said bodies about an axis generally parallel to said direction relative to the other body and thereby relatively oppositely displacing said bodies by means of said formation through a relatively short distance in said directions so as to displace said tippable element from said slide position to said locked position and thereafter to displace said elements relative to said one member.

8. The clamp defined in claim 7, wherein said one member is said fixed member.

9. The clamp defined in claim 7, wherein said one member is said movable member.

10. The clamp defined in claim 7, wherein said elongated member is fixed to said fixed member and said movable member is slidable in said direction along said elongated element.

11. The clamp defined in claim 10, wherein two such elongated elements extend from said fixed member through said movable member, two such tippable elements being provided each on a respective elongated element.

12. The clamp defined in claim 11, further comprising a secondary fixed member at the opposite ends of said elongated elements from the first-mentioned fixed member.

13. The clamp defined in claim 7, further comprising a spring urging said tippable element into said slide position.

14. The clamp defined in claim 13, wherein said spring is a compression spring surrounding said elongated element.

15. The clamp defined in claim 7, wherein said movable member is substantially hollow and the expansible means is mainly within said movable member.

16. The clamp defined in claim 7, wherein said fixed member is provided with a flange for securing said movable member to a bench and the like.

17. The clamp defined in claim 7, further comprising a guide along which is slidable said movable member and an end member fixed at the opposite end of said guide from said fixed member, said elongated element extending through said end member and having one end fixed in said directions in said movable member and another end provided with a knob, said means bearing against said end member and therethrough against said fixed member.

18. The clamp defined in claim 17, wherein said end member is hollow and contains said means.

19. The clamp defined in claim 18, wherein said guide is a pair of parallel rods fixed in said fixed and end members and extending in said directions therebetween and through said movable member, said movable member being slidable along said rods.

20. The clamp defined in claim 7, wherein said means includes a crank having a handle.

21. The clamp defined in claim 7, wherein said formation is a screw thread and said one body is an actuator rod.

22. The clamp defined in claim 7, wherein said one body is an actuator rod extending along said axis and said means includes a handle on the end of said rod opposite said one member.

23. The clamp defined in claim 7, wherein said one body has a planar face extending at an inclination to said axis and constituting said formation and said other body having an arm bearing on said face.

* * * * *